US005262005A

United States Patent [19]

Eriksson et al.

[11] Patent Number: 5,262,005

[45] Date of Patent: Nov. 16, 1993

[54] EASILY DEFIBERED WEB-SHAPED PAPER PRODUCT

[75] Inventors: Lennart Eriksson; Milan Kolar, both of Sundsvall; Tjell-Ake Hägglund, Söråker; Hans Höglund, Matfors, all of Sweden

[73] Assignee: SCA Pulp AB, Timra, Sweden

[21] Appl. No.: 689,792

[22] PCT Filed: Oct. 30, 1989

[86] PCT No.: PCT/SE89/00605

§ 371 Date: Jul. 9, 1991

§ 102(e) Date: Jul. 9, 1991

[87] PCT Pub. No.: WO90/05808

PCT Pub. Date: May 31, 1990

[30] Foreign Application Priority Data

Nov. 17, 1988 [SE] Sweden ..... 8804162

[51] Int. Cl.[5] ..... D21H 23/00

[52] U.S. Cl. ..... 162/100; 162/142; 162/158

[58] Field of Search ..... 162/100, 146, 13, 142, 162/150, 149, 9, 158

[56] References Cited

U.S. PATENT DOCUMENTS

| | | | |
|---|---|---|---|
| 3,617,439 | 11/1971 | Chapman, Jr. . | |
| 3,819,470 | 6/1974 | Shaw | 162/9 |
| 3,930,933 | 1/1976 | George et al. . | |
| 4,036,679 | 7/1977 | Back et al. | 162/9 |
| 4,081,316 | 3/1978 | Aberg | 162/100 |
| 4,105,033 | 8/1978 | Chatterjee et al. | 162/149 |
| 4,303,471 | 12/1981 | Laursen . | |
| 4,432,833 | 2/1984 | Breese . | |
| 4,481,076 | 11/1974 | Herrick | 162/9 |
| 4,557,800 | 12/1985 | Kinsley, Jr. | 162/100 |

FOREIGN PATENT DOCUMENTS

| | | |
|---|---|---|
| 0132128 | 1/1985 | European Pat. Off. . |
| 0184603 | 6/1986 | European Pat. Off. . |

*Primary Examiner*—W. Gary Jones
*Assistant Examiner*—Brenda Lamb
*Attorney, Agent, or Firm*—Young & Thompson

[57] ABSTRACT

The invention relates to a product easy to disintegrate, containing cellulose-containing fiber material, which has such a strength, that it can be reeled up or handled in sheet shape for storage and transport, without the addition of chemicals, which increase the bonding strength between the fibers. The product is characterized in that it has a density of 550–1000 kg/m$^3$, a bursting index of 0.15–0.50 MN/kg and a grammage of 300–1500 gm$^2$, and that the product has a dry solids content of 70–95%.

9 Claims, 1 Drawing Sheet

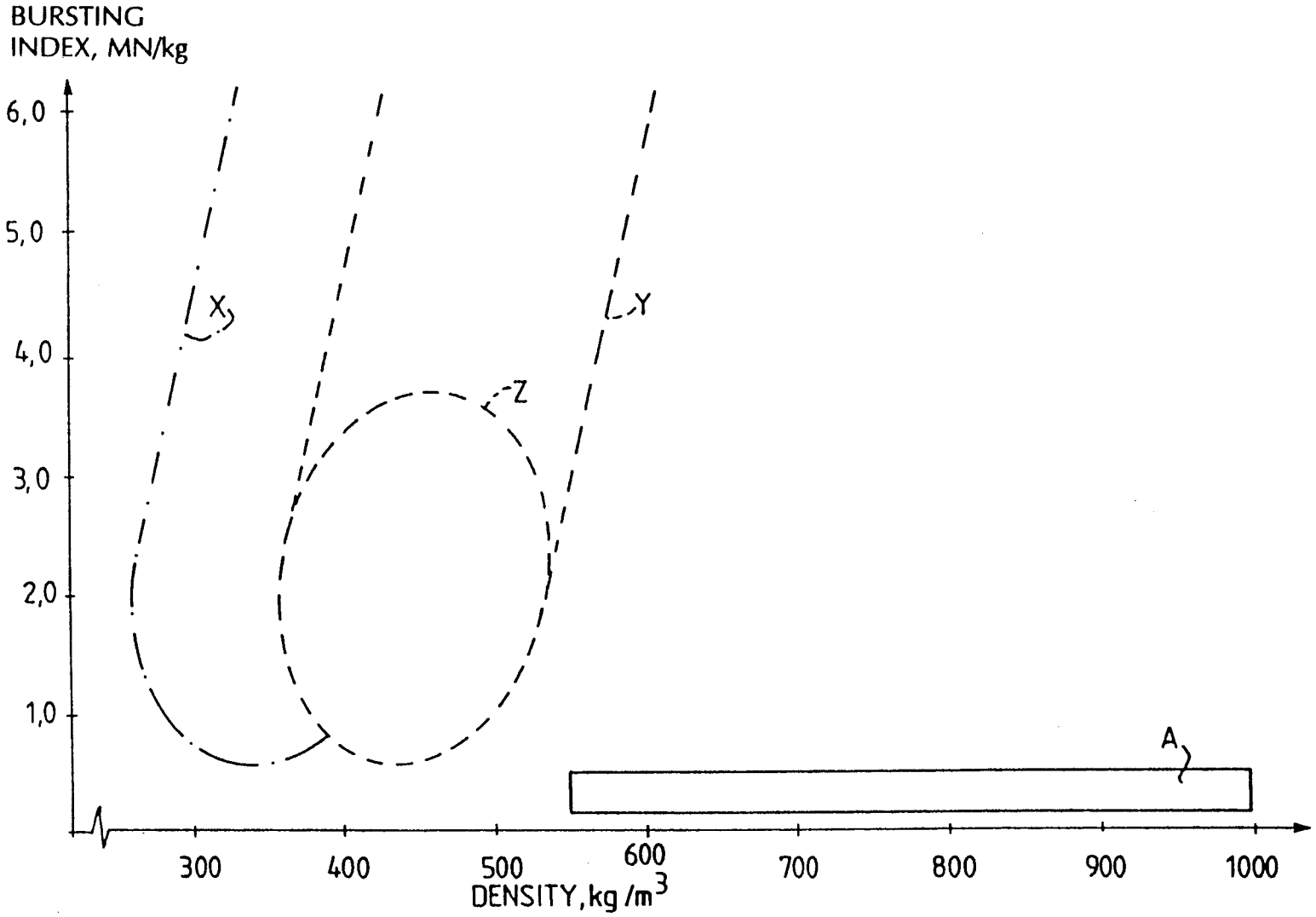
BURSTING
INDEX, MN/kg
6,0
5,0
4,0
3,0
2,0
1,0
300
400
500
600
700
800
900
1000
DENSITY, kg/m3
X
Y
Z
A

EASILY DEFIBERED WEB-SHAPED PAPER PRODUCT

FIELD OF THE INVENTION

This invention relates to a paper product of the kind being dry-defibered and converted to fluffed state for manufacturing thereof, for example, sanitary articles, such as napkins and sanitary towels.

BACKGROUND OF THE INVENTION

Materials of this kind have long been used for the manufacture of products of the kind in question, and are produced and marketed in the form of sheets or rolls. As fibre material, sulphite or sulphate pulp and also chemimechanical pulp, so-called CTMP, are used.

These products conventionally are produced in the wet way in that a fibre suspension is dewatered on a wire, pressed and dried. The dried web is reeled up or cut to sheets. As a starting material sulphate or sulphite pulp or chemimechanical pulp (CTMP) are used. The pulps made in this way are sold as so-called roll or sheet pulp.

The pulps alternatively can be sold in web shape after flash drying of the fibres. At flash drying the pulp fibres are dried in a fan drier. A pulp web is hereby pressed to about 50% dry solids content and torn so that individual fibres or fibre flocks are detached and thereafter dried when passing through the piping of the fan drier. The flash dried pulp then is pressed to bales. The resulting product has a high density, which offers transport-technical advantages compared with reel or sheet pulp. The transport economy of reel pulp, moreover, is made worse by the fact that cylindrical rolls have a low packing degree.

The chain of manufacture for soft absorption materials, such as napkins and towels, starts with the dry defibering or tearing of sheet, reel or bale pulp in order to detach the individual fibres bound in the sheet, web or bale. Due to their low moisture content, the pulp fibres then are relatively brittle. When there is a high bonding strength between the fibres in sheet, reel or bale pulp, the risk is great that the fibres will be damaged at the dry tearing and that much undesirable so-called fine material or dust will be formed. This is due to the fact, that a high bonding strength between the fibres implies high defibering energy. The producers of reel and flash dried pulp, therefore, are required to try to produce a product which can be torn as easily as possible, with weak fibre bonds in the product, which, however, must meet certain strength requirements for having good runnability in the defibering equipment. In order to obtain a product easy to tear, the roll or sheet manufacture in the commercial processes of to-day must increase the bulk of the product, which then also deteriorates its transport economy.

These problems are solved by the present invention.

SUMMARY OF THE INVENTION

The invention, thus, relates to a produce easy to defiber which substantially contains cellulose-containing fibre material, which at defibering can easily be converted to fluffed state and used in the manufacture, for example, of products for sanitary purposes, such as napkins and towels, and filters. This web-shaped product has such a strength that it can be reeled up or handled in sheet shape for storing and transport, without the addition of chemicals for increasing the bonding strength between the fibres.

According to the invention, the product has a density of 550–1000 kg/m$^3$, preferably 550–700 kg/m$^3$, a bursting index of 0.15–0.50 MN/kg, preferably 3.20–0.40 MN/kg and a grammage of 300–1500 g/m$^2$, preferably 500–1000 g/m$^2$, the product having a dry solids content of 70–95%.

The values are determined according to the following standards issued by the Scandinavian Pulp, Paper and Board, Testing Committee.

| | |
|---|---|
| Density | SCAN-P 7:75 |
| Bursting strength | SCAN-P 24:77 |
| Grammage | SCAN-P 6:75 |
| Dry solids content | SCAN-P 4:63 |

According to an important embodiment of the product according to the invention, the cellulose-containing fibre material is a lignocellulose high yield pulp, i.e. a pulp manufactured in a yield exceeding 90%.

According to an espicially important embodiment, the fibres have a curl value of 0.20–0.40. x) (cp page 5)

The product according to the invention can also contain thermo fibres and/or super-absorbing polymers.

BRIEF DESCRIPTION OF THE DRAWING

The invention is described in greater detail in the following by way of an embodiment thereof and with reference to a diagram showing the bursting strength and density of the invention and various known products.

DETAILED DESCRIPTION OF THE INVENTION

Flash dried fibres of a chemi-mechanical pulp, so-called CTMP, with a dry solids content of about 80% were formed to a web with a grammage of about 500 g/m$^2$ in a so-called Pendistor, in which the fibres in a controlled flow are supplied by an air stream to a forming head located over a wire. By using jets, a uniform distribution of the fibres on the wire is obtained, while the air is sucked off by a suction box located beneath the wire. The web was pre-pressed in order to reduce the bulk of the web slightly before the final pressing to high density. The final pressing was carried out in a calendar, where the temperature of the rolls was 110° C. and the linear load was 180 kN/m.

The pressed web then was reeled up in a reel stand. The product had the properties as follows:

| | |
|---|---|
| Density | 570 kg/m$^3$ |
| Bursting index | 0.24 MN/kg |
| Dry solids content | 83% |

In the accompanying diagram the properties of several pulps as regards the bursting index and density are shown. The area for chemi-mechanical pulp (CTMP) wet-formed in conventional manner is designated by X, and for wet-formed sulphate pulp by Y. Within the latter area an area has been designated by Z. This area refers to wet-formed sulphate pulp, to which so-called debonds have been added.

The product according to the invention lies in the area A and differs apparently essentially from previously known products.

The reel pulp manufactured according to the above example from CTMP-pulp was then used for making napkins in a test machine.

The reel pulp was dry defibered in a so-called hammer mill, which is comprised in the standard equipment for dry defibering of pulp webs at fluff pulp defibering.

As reference at the tests two commercial reel pulps were used which had been wet-formed according to conventional technique, viz. a CTMP-pulp and a sulphate pulp. The pulps had the properties as follows:

| | CTMP | Sulphate |
|---|---|---|
| Density, kg/m$^3$ | 340 | 450 |
| Bursting index, MN/kg | 1.0 | 1.5 |
| Dry solids content, % | 90 | 90 |

At tests carried out on the defibered pulps included as raw material, the following values were obtained:

| Starting material | Network strength N | Curl dimensionless | Bulk m$^3$/kg | Fractionation residue % |
|---|---|---|---|---|
| Invention | 5.3 | 0.21 | 17.4 | 1.4 |
| Wet-formed CTMP | 5.4 | 0.15 | 18.4 | 2.1 |
| Wet-formed sulphate pulp | 4.7 | 0.23 | 16.3 | 10.5 |

Fractionation residue is to be understood as the percent proportion of undefibered fibre material.

The Curl value, which is dimensionless, is measured according to a method of B. D. Jordan and N. G. Nguyen i "Curvature, kink and curl" in Papper och Trå 4/1986, page 313, FIG. 2.

All pulps were defibered in like manner in a hammer mill.

As appears from the Table, the reel pulp according to the invention shows properties well as good as the reference material, but the disadvantages of the latter are removed. The fractionation residue for the material according to the invention, however, is considerably lower. This proves that the product according to the invention is very easy to defiber, although the energy input here is much lower than for the reference material.

The invention is not restricted to the embodiment described, but can be varied within the scope of the invention idea.

We claim:

1. Easily defibered web-shaped product containing substantially cellulose-containing fiber material, which at defibering can easily be converted to a fluffed state containing a high proportion of free fibers, said product adapted to be used in manufacture of products for sanitary purposes, selected from the group consisting of napkins, towels and filters, said web-shaped product having such a strength, that it can be reeled up or handled in sheet shape for storing and transport, without addition of chemicals for increasing bonding strength between the fibers, said product having a density of 550–1000 kg/m$^3$, a bursting index of 0.15–0.50 MN/kg, a grammage of 300–1500 g/m$^2$, and a dry solids content of 70–95%.

2. Easily defibered web-shaped product as defined in claim 1, wherein said product has a density of 550–700 kg/m$^3$.

3. Easily defibered web-shaped product as defined in claim 1, wherein said product has a bursting index of 0.20–0.40 MN/kg.

4. Easily defibered web-shaped product as defined in claim 1, wherein said product has a grammage of 500–1000 g/m$^2$.

5. Easily defibered web-shaped product as defined in claim 1, wherein said product contains super-absorbing polymers.

6. Easily defibered web-shaped product as defined in claim 1, wherein the cellulose-containing material is a lignocellulose-containing material.

7. Easily defibered web-shaped product as defined in claim 6, wherein the lignocellulose-containing material is a pulp made in a yield exceeding 90%.

8. Easily defibered web-shaped product as defined in claim 6, wherein the lignocellulose-containing fibers have a curl value of 0.20–0.40.

9. Easily defibered web-shaped product as defined in claim 7, wherein the lignocellulose-containing fibers have a curl value of 0.20–0.40.

* * * * *